US011940230B2

(12) United States Patent
Thomsen et al.

(10) Patent No.: US 11,940,230 B2
(45) Date of Patent: Mar. 26, 2024

(54) MULTI PORT EXTRUSION (MPE) CONNECTION TO A HEADER

(71) Applicant: HYDRO EXTRUDED SOLUTIONS AS, Oslo (NO)

(72) Inventors: Torben Thomsen, Krusaa (DK); Henrik Jørgensen, Gråsten (DK); Preben H. Gaul, Tønder (DK)

(73) Assignee: HYDRO EXTRUDED SOLUTIONS AS, Oslo (NO)

( * ) Notice: Subject to any disclaimer, the term of this patent is extended or adjusted under 35 U.S.C. 154(b) by 135 days.

(21) Appl. No.: 17/429,112

(22) PCT Filed: Mar. 6, 2020

(86) PCT No.: PCT/EP2020/056073
§ 371 (c)(1),
(2) Date: Aug. 6, 2021

(87) PCT Pub. No.: WO2020/187612
PCT Pub. Date: Sep. 24, 2020

(65) Prior Publication Data

US 2022/0065555 A1 Mar. 3, 2022

(30) Foreign Application Priority Data

Mar. 15, 2019 (NO) ..... 20190345

(51) Int. Cl.
*F28F 9/14* (2006.01)
*F28F 1/02* (2006.01)
(Continued)

(52) U.S. Cl.
CPC ..... *F28F 1/022* (2013.01); *F28F 9/0248* (2013.01); *F28F 9/0258* (2013.01); *F28F 9/14* (2013.01);
(Continued)

(58) Field of Classification Search
CPC ..... F28F 1/022; F28F 9/0248; F28F 9/165; F16L 37/133
See application file for complete search history.

(56) References Cited

U.S. PATENT DOCUMENTS 5,170,841 A * 12/1992 Briet ..... F28F 9/0258 165/76
2007/0023172 A1* 2/2007 Obrist ..... F28D 1/05391 165/174
(Continued)

FOREIGN PATENT DOCUMENTS

DE 10 2016 125 859 7/2017
EP 1 327 847 7/2003
(Continued)

OTHER PUBLICATIONS

International Search Report and International Written Opinion of the International Searching Authority dated Aug. 3, 2020, in International (PCT) Application No. PCT/EP2020/056073.

*Primary Examiner* — Devon Russell
(74) *Attorney, Agent, or Firm* — Wenderoth, Lind & Ponack, L.L.P.

(57) ABSTRACT

A connection between one end of a Multi Port Extrusion (MPE) tube (1) of aluminium or an aluminium alloy and one header (2), the connection comprises an adapter (3) with a seal ring (4) fixed between the MPE tube and the header. The invention also relates to a method for connecting said parts.

13 Claims, 7 Drawing Sheets

(51) Int. Cl.
*F28F 9/02* (2006.01)
*F28F 9/16* (2006.01)
*F28F 21/08* (2006.01)

(52) U.S. Cl.
CPC ..... *F28F 9/165* (2013.01); *F28F 21/084* (2013.01); *F28F 2255/16* (2013.01); *F28F 2275/025* (2013.01); *F28F 2275/085* (2013.01); *F28F 2280/06* (2013.01)

(56) References Cited

U.S. PATENT DOCUMENTS

| | | | | |
|---|---|---|---|---|
| 2008/0110608 | A1 | 5/2008 | Gorbounov et al. | |
| 2017/0196127 | A1 | 7/2017 | Seidl et al. | |
| 2017/0343144 | A1* | 11/2017 | Hunt | F16L 41/021 |
| 2019/0049049 | A1* | 2/2019 | Ignaczak | G06K 19/07758 |
| 2023/0027286 | A1* | 1/2023 | Veraza | F16L 37/098 |

FOREIGN PATENT DOCUMENTS

| | | | | |
|---|---|---|---|---|
| FR | 2 504 667 | | 10/1982 | |
| WO | WO-2018206895 | A1 * | 11/2018 | F28D 1/05383 |

* cited by examiner

MULTI PORT EXTRUSION (MPE) CONNECTION TO A HEADER

The present invention relates to the design of a connection of a Multi Port Extrusion tubing to a header, and a method for connecting such a tubing to same. In particular, the invention relates to an adapter between the MPE and the header.

Micro channel or micro port heat exchangers based on multiport extruded profiles (MPE) of aluminium or aluminium alloys are known where the inlets and outlets of the heat exchangers are provided with headers or manifolds to distribute, respectively collect the refrigerant flowing through the multiport extrusions.

MPE profiles are mainly applied in brazed solution where many connections are handled in a one shot brazing process. For applications where the number of connections is reduced, the "one shot" brazing process is no longer preferred and other methods of connections are needed.

From FR 2504667 it is known a connection between a multiport tube and an elongated profiled main body that has a recess for fixation of one end of the tube. The multiport tube is entered into the recess that has resilient walls that sustain a gripping force onto the tube. At the opposite side of the recess there is arranged an elongated opening that can be closed by a corresponding lid, which also has one outlet/inlet opening. The parts can be made out of a plastic material and joined together by an ultrasonic based method.

DE 10 2016 125 859 A1 discloses joining an extruded metallic tube with a connecting body of plastic material, wherein the tube is entered into a receiving part of the body. The receiving part has one first opening corresponding to the outer dimensions of the tube and one second opening somewhat larger than that wherein a gluing compound is applied to fix the parts together.

US 2017343144 A1 relates to a connection between a multiport flat tube and a header/connector body. An adapter 58 is fixed between the tube and the connector body 32. The adapter is preferably made of a single, integral piece of plastic through an injection molding process and is adhesively bonded with an elongated wall 38 of the connector body 32 to establish a permanent (non-detachable) connection between the adapter and the connector body. Fixation can be done by gluing or adhesive. The flat tube can be provided with locking tabs that are fixed to the tube by an adhesive. The locking tabs have corresponding locking elements arranged in the adapter to lock the flat tube to the adapter.

US 2008110608 A1 relates to a connection between a multichannel tube and a header, employing a transition connector between the tube and header where a heat exchanger includes a plurality of flat, multi-channel heat exchange tubes extending between spaced headers. Each heat exchange tube has its inlet end in fluid flow communication to an inlet header through a transition connector. The transition connector has a body defining a divergent flow path extending from an inlet opening in its inlet end to an outlet opening in its outlet end, and a tubular nipple extending outwardly from the inlet end of the divergent flow path through the wall of the inlet header. The tubular nipple defines a fluid flow path extending between the inlet end of the divergent flow path of the transition connector and the fluid chamber of the inlet header. The inlet header has a lateral dimension less than the lateral dimension of the heat exchange tube. The parts can be joined by welding, brazing or other bonding technique.

The present invention opens the possibility of making simple connections on site without any kind of heat treatment related to brazing. Brazing will normally have a negative influence on the mechanical properties of the connected parts, in particular metal alloys.

Furthermore, the present invention makes it possible to make simple connections involving MPE profiles coated with materials that cannot endure elevated temperatures. Such coating materials can be applied for protecting the metal from corrosive fluids. Where such coating is not necessary, the invention can be applied for uncoated MPE profiles as well.

The invention is suited for applications in cooling systems with water/Glycol, and is in particular related to battery thermal management.

SUMMARY OF THE INVENTION

The present invention relates to a Multi Port Extrusion tubing (MPE tubing) made from a Multi Port Extrusion (MPE). More specifically, the invention relates to the joint between at least one end of such MPE tubing and a corresponding header where there is arranged an adapter between the MPE tubing's end and the header.

According to the present invention there is also described a method for preparing and joining the MPE tubing to the header, where the method will ensure a joint with predefined fixation position between the parts, and further a mechanical fixation which can easily be assembled on site without any special tools or processes.

Since the connection is made without heating the parts by brazing or welding this allows for application of coated MPE tubing to the header which otherwise would not withstand the temperature during brazing. The invention is suitable for application of precoated wide MPE-profiles for battery cooling that can be assembled on site, and preferably in a vehicle in an assembly line. The principles of the invention can be applied for uncoated MPE tubing as well.

The present invention relates to a connection between one end of a Multi Port Extrusion (MPE) tube 1 preferably of aluminium or an aluminium alloy and one header 2 where the connection comprises an adapter 3 fixed between the MPE tube 1 and the header 2. According to one aspect of the invention, one end of the MPE tube 1 is mating a cavity 1' in a first end of the adapter. According to a second aspect of the invention, one end of the adapter 3 comprises a protrusion 7 that is entered into a cavity 7' of the header 2. Another aspect of the invention is related to a seal ring 4 is arranged between the adapter 3 and the header 2. Still another aspect of the invention is that the fixation between the MPE tubing 1 and the adapter 3 and/or the adapter 3 and the header 2 is established by mechanical fixation means, such as notches and openings/recesses similar to snap-on connections. According to one aspect of the invention, the fixation between the MPE tubing 1 and the adapter 3 is established in that the MPE tubing 1 has at least one indent 5, 5' close to its end that is complementary to a corresponding pre-shaped notch 12, 12' in the adapter. Another aspect of the invention is that the mating of the at least one notch 12, 12' in the corresponding indent 5, 5' is securely locked in that the header 2 embraces the adapter 3 and lays onto its outer surface in that area. One further aspect of the invention is that the seal ring is arranged between an internal flange of the header 2 and a complementary flange or seat of the adapter. In still another aspect, the fixation between the adapter 3 and the header 2 is established by that the adapter's 3 second end has at least one notch 10, 10' that is complementary to a corresponding opening 11, 11' in a wall of the header 2. In one aspect of the invention, the adapter (3) is made of a flexible material, preferably plastic or the similar, while the header (2) is made of aluminium or an alloy thereof or a plastic material.

In one other aspect of the invention it is presented a method for connecting one end of a Multi Port Extrusion (MPE) tubing 1 and one header 2, where one end of the MPE tubing 1 is entered into a first end of an adapter 3 and fixed by mechanical fixation means, and where one second end of the adapter 3 is provided with a seal ring 4 and further entered into a corresponding recess in the header 2 and fixed by mechanical fixation means.

These and further advantages can be achieved by the invention according to the accompanying claims.

BRIEF DESCRIPTION OF THE DRAWINGS

The invention will be further described in detail in the following by means of examples and with reference to the attached drawings where.

DESCRIPTION OF THE INVENTION

Figure 1:
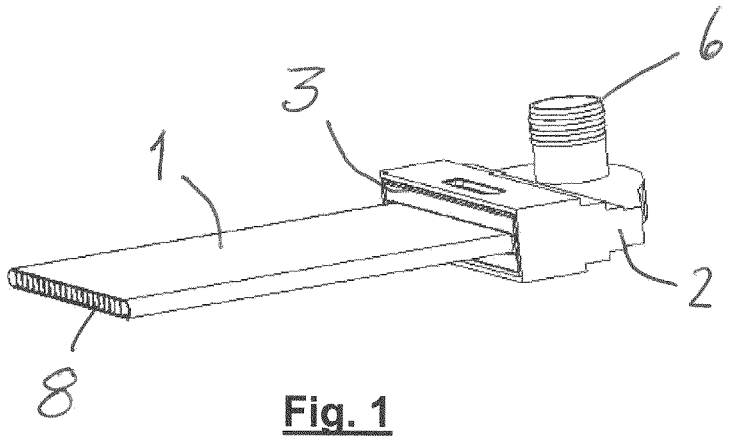
FIG. 1 shows a connection between a MPE tubing and a header, seen in perspective.

FIG. 1 shows connection between a Multi Port Extrusion tubing (MPE tubing) with ports 8 and a header 2 with a fluid connection 6, seen in perspective. An adapter 3 is partly shown. The MPE tubing can be made from aluminium or an alloy thereof and can have various shapes or design. Other materials would also work within the scope of the invention such as other metallic materials as well as plastic materials. The header can be of metallic such as aluminium or an alloy thereof or any appropriate plastic material, and have alternative design. The same applies for the fluid connection 6 that can have alternative design, and for instance comprise more than one fluid connection.

Figure 2:
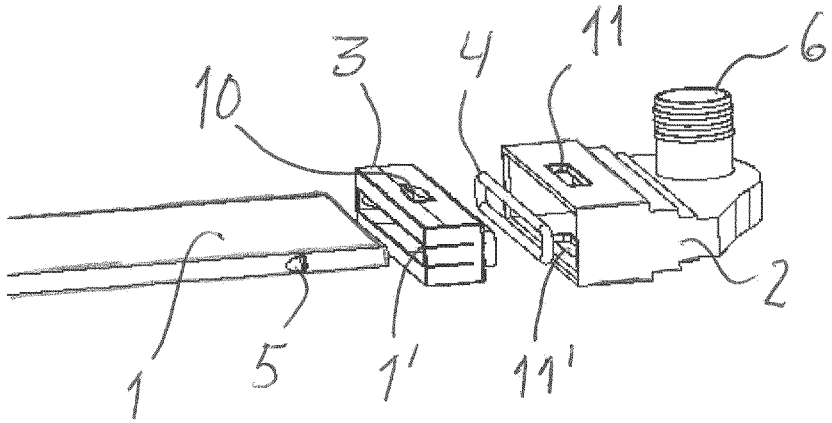
FIG. 2 shows the connection of FIG. 1 in perspective and further in an exploded view including MPE tubing, adapter, sealing and header.

FIG. 2 shows the connection of FIG. 1 and further in an exploded view including MPE tubing, adapter 3, seal 4 and header 2. The seal can be a standard, flexible O-ring of appropriate material, for instance a rubber based material, and having a circular cross section. The O-ring will have an oval form after assembly. The adapter 3 is provided with a notch 10 mating an opening 11 in the top side of the header. Similar notch (not shown) and opening 11' is provided at the bottom side of the parts. The said notches and openings firmly locks the adapter to the header when the parts are brought together. The MPE tubing is provided with one indent 5 that corresponds with a notch in a cavity 1' of the adapter. The adapter can be of any elastic or flexible material.

Figure 3:
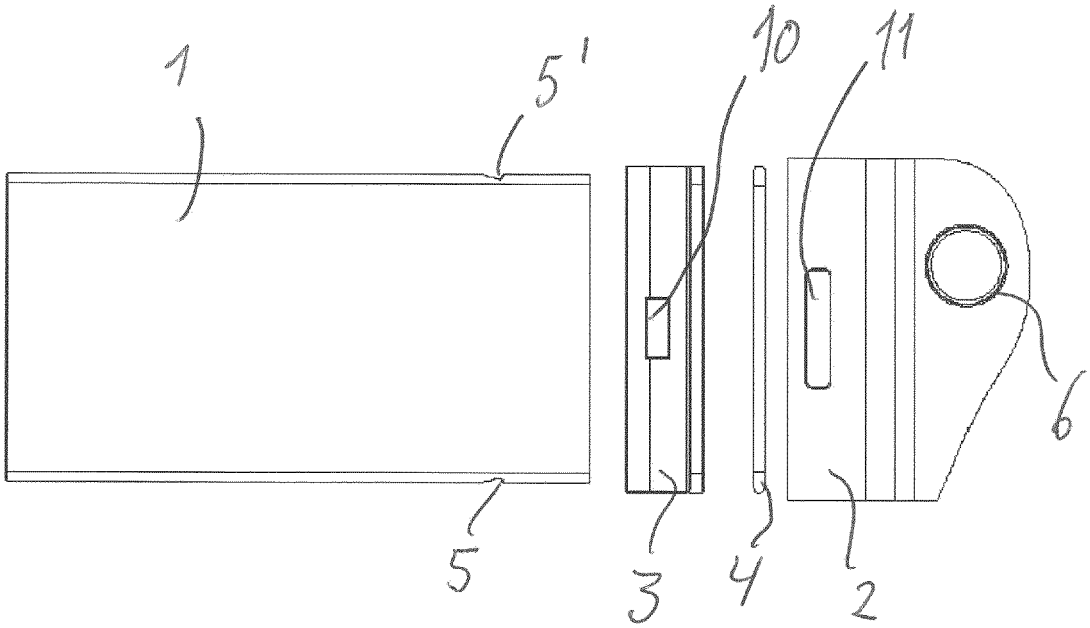
FIG. 3 shows the connection of FIG. 2, seen from above, including MPE tubing, adapter, sealing and header.

FIG. 3 shows the connection of FIG. 2, seen from above, including MPE tubing 1 with two indents 5, 5', adapter 3 with notch 10, seal 4 and header 2 with fluid connection 6 and opening 11. The locking function between the notch and the opening secures a predefined pressure onto the seal. The indents 5, 5' can have different shape and design. One important feature of these indents is that they can be prefabricated in a production line where the position of the indents from the end of the tubing as well as the shape of same can be of very high accuracy. This will facilitate and secure that the assembly of the tubing with the rest of the parts will be accurate.

Figure 4:
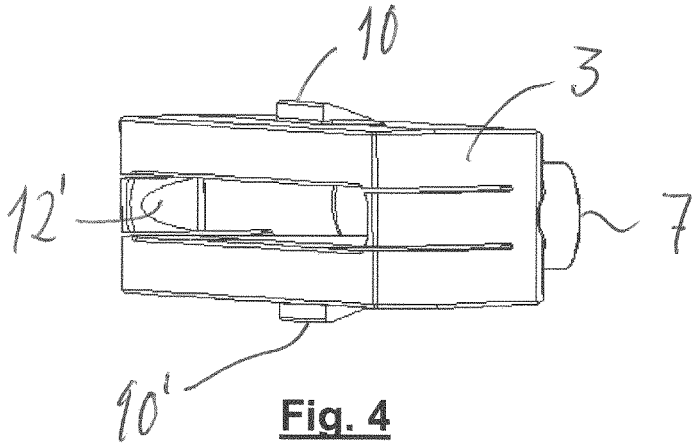
FIG. 4 shows an adapter, seen in perspective.

FIG. 4 shows an adapter 3, seen in perspective, with one upper notch 10, one lower notch 10' and a receiving space for the MPE tubing having notches 12', 12 (see FIG. 5) that mates the indents 5, 5' of the MPE tubing for firmly locking same to the adapter. Further, the adapter has a protrusion 7 that serves as a seat for the seal 4. The adapter may have various shapes.

Figure 5:
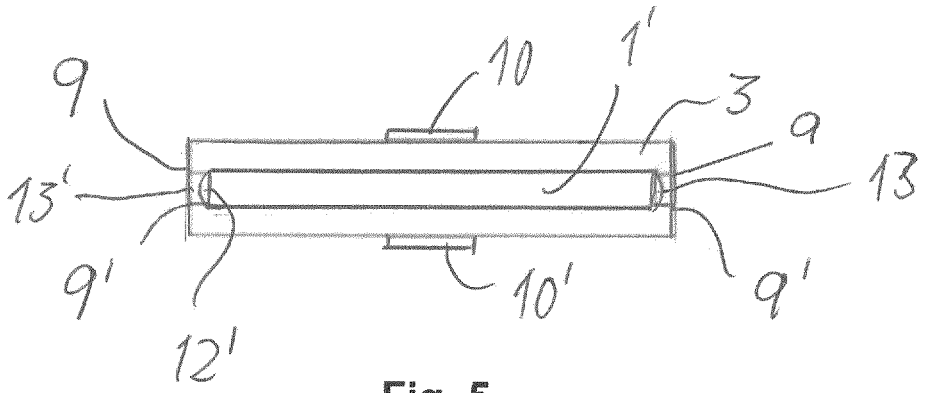
FIG. 5 shows the adapter of FIG. 4, seen from left end.

FIG. 5 shows the adapter 3 of FIG. 4, seen from left end, with a cavity 1' with upper and lower notches 10, 10' and the notches 12, 12' that mates the corresponding indents 5, 5' of the MPE tubing. The side walls of the adapter are preferably provided with two slits 9, 9', one at each side of the parts 13, 13' where the notches are arranged. This will give a resilient movement of the parts, which becomes restricted against movement in the final part of the assembling process.

Figure 6:
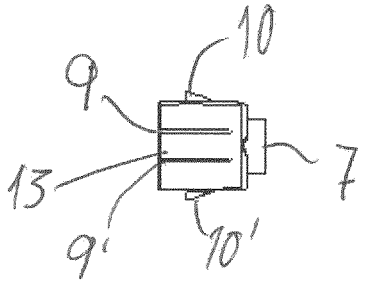
FIG. 6 shows the adapter of FIG. 4, seen from one side.

FIG. 6 shows the adapter 3 of FIG. 4, seen from one side, with upper and lower notches 10, 10', and the protrusion 7. There is shown two slits 9, 9' and the part 13 between these slits.

Figure 7:
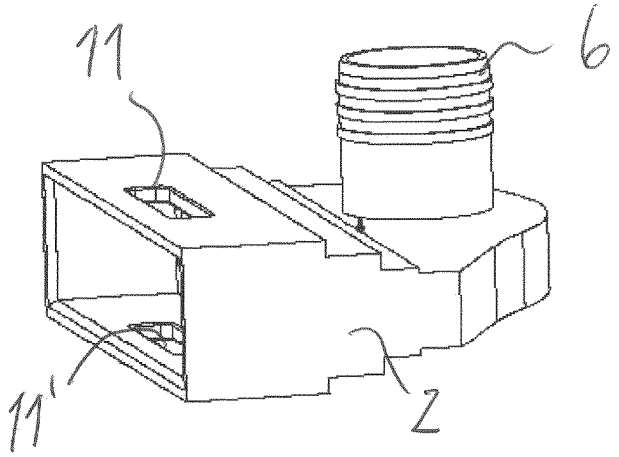
FIG. 7 shows the header of FIG. 2, seen in perspective.

FIG. 7 shows the header 2 of FIG. 2, seen in perspective, with fluid connection 6 upper and lower openings 11, 11'.

Figure 8:
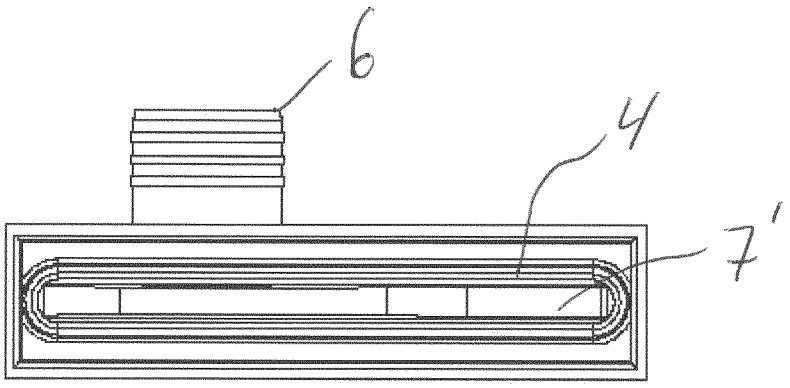
FIG. 8 shows the header of FIG. 7 seen from left side.

FIG. 8 shows the header 2 of FIG. 7 seen from left side, with fluid connection 6, seal 4 and a receiving cavity 7' for the protrusion 7 of the adapter 3.

Figure 9:
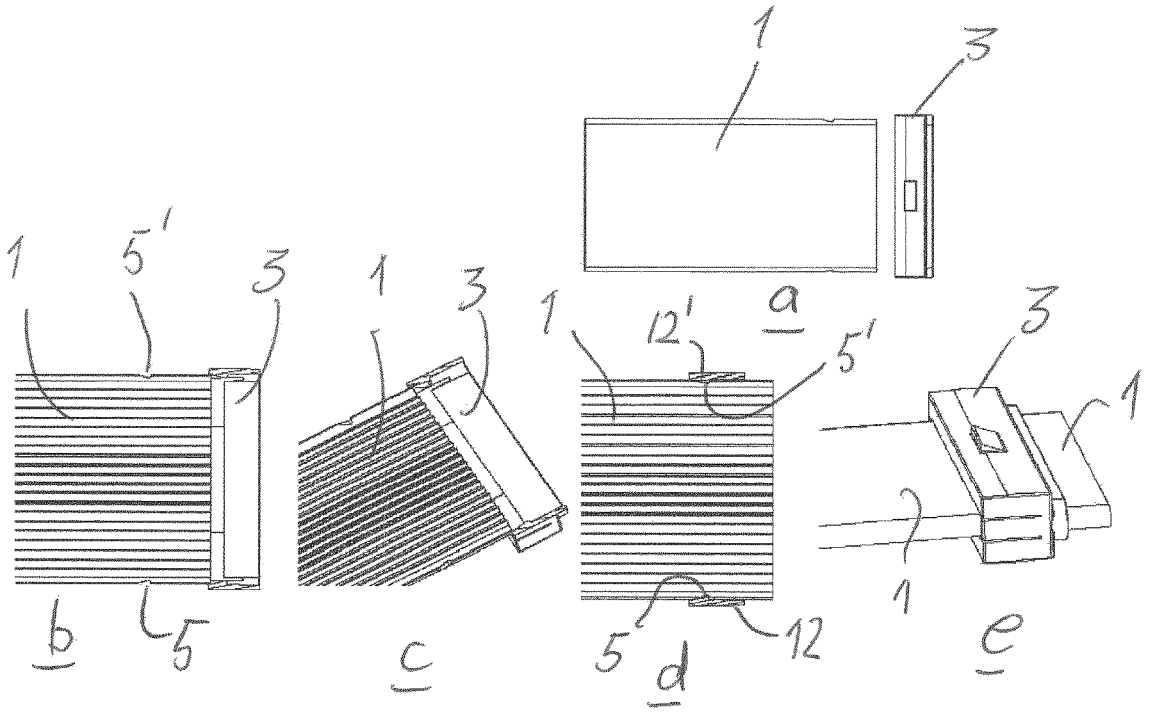
FIG. 9 shows in steps the connection process between a MPE tubing and one adapter, FIG. 10 discloses the connection process between the MPE tubing fixed to the adapter and a sealing ring, FIG. 11 discloses the connection process of the MPE tubing with the adapter and the sealing ring and further to a header, seen in perspective, FIG. 12 discloses a detail of the header supporting the fixation of adapter to the MPE tubing, in a cross-sectional view, FIG. 13 discloses in a sideview the complete assembly of MPE tubing and header, FIG. 14 discloses a cross sectional view of the assembly in FIG. 13, FIG. 15 discloses in perspective a cross sectional view of the assembly in FIG. 13.

FIG. 9 shows in steps the connection process between a MPE tubing and one adapter, where in step a the MPE tubing 1 and adapter 3 is aligned for assembly, in step b and c the MPE tubing is entered into the adapter and the flexible snap function of the notches 10, 10' is activated, in step d the notches 12, 12' of the adapter 3 have entered the corresponding indents 5, 5' of the MPE tubing 1 and in step e the MPE tubing and adapter is assembled.

Figure 10:
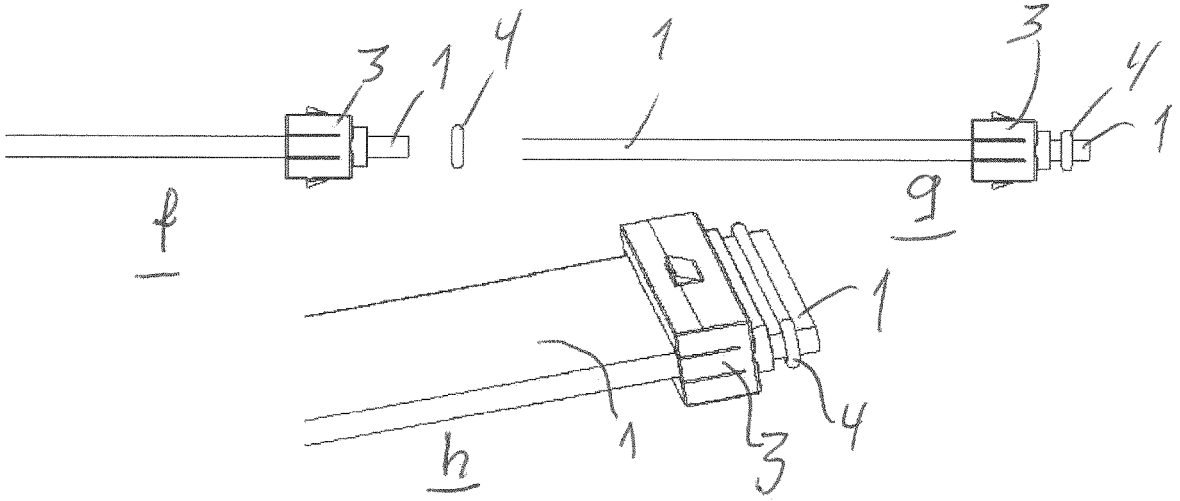

FIG. 10 discloses the connection process between the MPE tubing 1 fixed to the adapter 3 and a seal 4 as shown in steps f, g, h. In step f the adapter 3 with the MPE tubing 1 is positioned versus the seal 4. In step g the seal 4 is entered onto the end of the MPE tubing, which also can be seen in perspective in step h.

Figure 11:
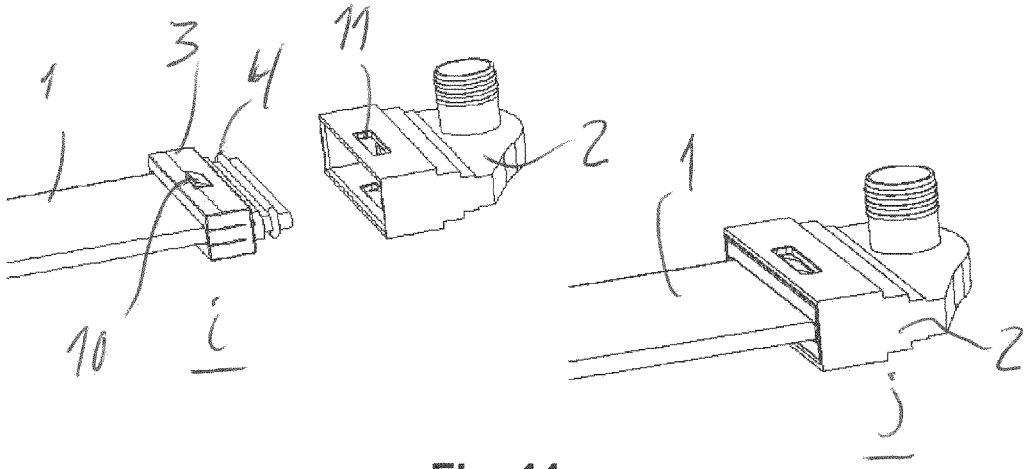

FIG. 11 discloses the connection process of the MPE tubing 1 with the adapter 3 and the sealing ring and further to a header 2 where the parts are aligned in step i and where the parts are brought together where the protrusion 7 of the adapter is entered into the cavity 7' of the header 2 and locked in step i.

Figure 12:
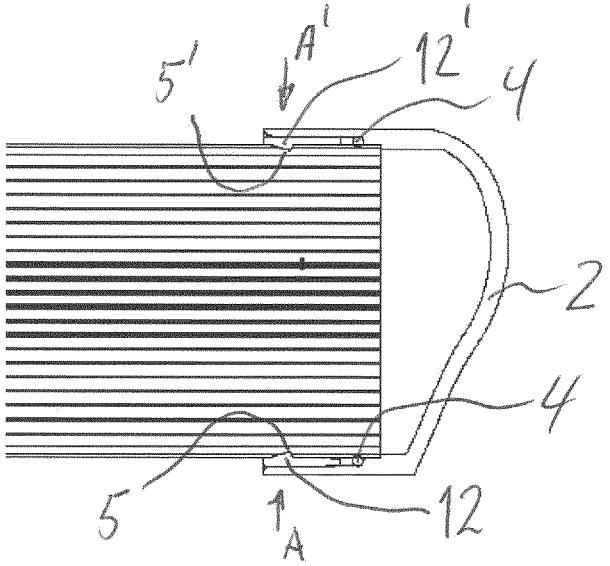

FIG. 12 discloses a detail of the header 2 supporting the fixation of adapter 3 to the MPE tubing 1. Here the notches 12, 12' of the adapter 3 is securely fixed in the indents 5, 5' by the header 2 which completely surrounds this part of the adapter and restrict the resilient parts 13, 13' of the adapter 3 where the notches are arranged to move outwards in the area of arrow A and A'. The header 2 has a wall thickness and strength in this area to provide secure locking of the notches 12, 12', so that the MPE tubing is kept in place even if high pressure is applied.

Figure 13:
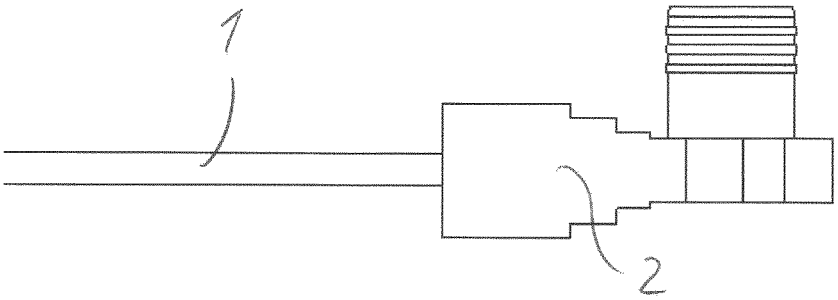

FIG. 13 discloses in a sideview the complete assembly of MPE tubing 1 and header 2, when the snap function of the parts is activated the parts can no longer be separated without use of special tooling.

Figure 14:
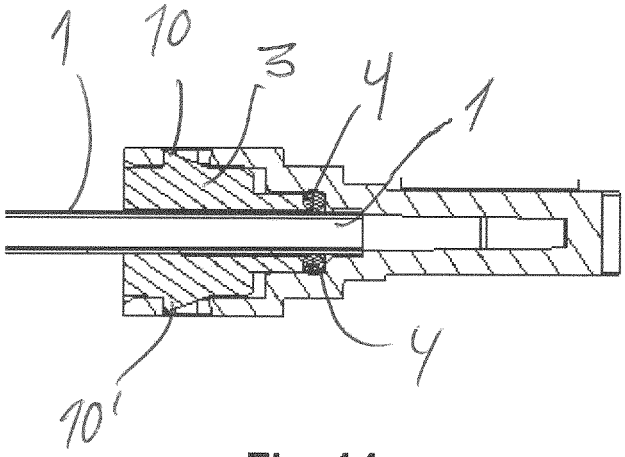

FIG. 14 discloses a cross sectional view of the assembly in FIG. 13, where the adapter 3 is arranged between the MPE tubing 1 and the header. The seal 4 is arranged between one end flange of the adapter and an internal flange of the header. Further, the MPE tubing abuts one internal step of the header 2. Notches 10, 10' are also shown.

Figure 15:
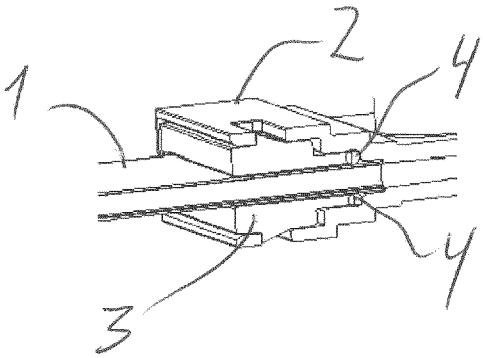

FIG. 15 discloses in perspective a cross sectional view of the assembly as shown in FIG. 14.

The invention claimed is:

1. A connection between one end of a Multi Port Extrusion (MPE) tube (1) and one header (2), the connection comprising an adapter (3) fixed between the MPE tube (1) and the header (2), where the end of the MPE tube (1) is mating a cavity (1') in a first end of the adapter (3), wherein the fixation between the MPE tubing (1) and the adapter (3) is established in that the MPE tubing (1) has at least one prefabricated indent (5, 5') close to its end that is complementary to a corresponding pre-shaped notch (12, 12') in the adapter (3), and wherein the mating of the at least one notch (12, 12') in the corresponding indent (5, 5') is securely locked in that the header (2) embraces the adapter (3) and lays onto its outer surface in that area.

2. The connection according to claim 1, wherein a second end of the adapter (3) comprises a protrusion (7) that is entered into a cavity (7') of the header (2).

3. The connection according to claim 1, wherein a seal ring (4) is arranged between the adapter (3) and the header (2).

4. The connection according to claim 1, wherein the fixation between the adapter (3) and the header (2) is established by mating snap-on elements.

5. The connection according to claim 1, wherein the fixation between the adapter (3) and the header (2) is established by gluing or cold hardening compound.

6. The connection according to claim 3, wherein the seal ring is arranged between an internal flange of the header (2) and a complementary flange of the adapter (3).

7. The connection according to claim 1, wherein the fixation between the adapter (3) and the header (2) is established by that the adapter's (3) second end has at least one notch (10, 10') that is complementary to a corresponding opening (11, 11') in a wall of the header (2).

8. The connection according to claim 1, wherein the adapter (3) is made of a flexible material.

9. The connection according to claim 1, wherein the header (2) is made of aluminium or an alloy thereof or a plastic material.

10. The connection according to claim 1, wherein the MPE tubing has a protective coating.

11. The connection according to claim 1, wherein the Multi Port Extrusion (MPE) tube (1) is made of aluminium or an aluminium alloy.

12. The connection according to claim 1, wherein the flexible material is plastic or the similar.

13. A method for connecting one end of a Multi Port Extrusion (MPE) tubing (1) and one header (2), wherein the one end of the MPE tubing (1) is entered into a first end of an adapter (3) and fixed by mechanical fixation means provided by at least one prefabricated indent (5, 5') close to its end that is complementary to a corresponding pre-shaped notch (12, 12') in the adapter (3) and where one second end of the adapter (3) is provided with a seal ring (4) and further entered into a corresponding recess in the header (2) and fixed by mechanical fixation means.

* * * * *